US008078079B2

(12) United States Patent
Brown et al.

(10) Patent No.: US 8,078,079 B2
(45) Date of Patent: Dec. 13, 2011

(54) AIR DUCT AND TONER CARTRIDGE USING SAME

(75) Inventors: Stephen Andrew Brown, Georgetown, KY (US); Jarrett Clark Gayne, Lexington, KY (US); Nicholas Fenley Gibson, Lexington, KY (US); Asmund Vego, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/421,725

(22) Filed: Apr. 10, 2009

(65) Prior Publication Data

US 2009/0202270 A1 Aug. 13, 2009

(51) Int. Cl.
*G03G 21/20* (2006.01)

(52) U.S. Cl. ..... 399/92; 399/94; 399/103

(58) Field of Classification Search ..... 399/92, 399/94, 103

See application file for complete search history.

(56) References Cited

U.S. PATENT DOCUMENTS 5,038,174 A * 8/1991 Kato et al. ..... 399/92
5,952,442 A 9/1999 Dowlen et al.
6,424,810 B1 7/2002 Chappell
7,079,785 B2 * 7/2006 Koshimura et al. ..... 399/94
2005/0095030 A1 * 5/2005 Foster et al. ..... 399/103

FOREIGN PATENT DOCUMENTS

JP 2006208673 A * 8/2006
JP 2006259118 A * 9/2006

OTHER PUBLICATIONS

English Abstract JP 2006208673A, cited in Foreign Patent Documents section directly above, published Aug. 2006.*
English Abstract of JP 2006-259118, Sep. 2006.*
Machine Translation of JP 2006-259118, Sep. 2006.*

* cited by examiner

*Primary Examiner* — David Porta
*Assistant Examiner* — Bryan Ready
(74) *Attorney, Agent, or Firm* — John Victor Pezdek; Justin M. Tromp

(57) ABSTRACT

A cartridge for containing toner material used in an image-forming device according to one example embodiment includes a developer roll, two J-seals that provide interfaces with the developer roll at the ends thereof, and an air duct that conducts airflow across the interfaces to cool the developer roll and seals. The air duct includes an elongated hollow body and a pair of nozzles in fluid communication with the hollow body. One of the nozzles is disposed at a distal end of the developer roll near one J-seal, and the other of the nozzles is disposed at a proximal end of the developer roll near the second J-seal.

16 Claims, 9 Drawing Sheets

AIR DUCT AND TONER CARTRIDGE USING SAME

CROSS REFERENCE TO RELATED APPLICATIONS

Cross-reference is made to copending U.S. patent application Ser. No. 11/959,016, entitled "Upper Seal for Inhibiting Doctor Blade Toner Leakage," filed Dec. 18, 2007 and U.S. patent application Ser. No. 11/959,058, entitled "Developer Roll Lip Seal", filed Dec. 18, 2007 both assigned to the assignee of the present invention.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to image-forming devices, and more particularly, to the cooling of a toner cartridge in an image-forming device.

2. Description of the Related Art

Image forming devices such as laser printers utilize a light beam that is focused to expose a discrete portion of a photoreceptive or image transfer drum in order to attract printing toner to these discrete portions. One component of a laser printer is the photoreceptive drum assembly. The photoreceptive drum assembly is made out of photoconductive material that is discharged by light photons, typically emitted by a laser. The drum is initially given a charge by a charge roller. As the photoreceptive drum revolves, the printer directs a laser beam across the surface to discharge certain points. In this way, the laser "draws" the letters and images to be printed as a pattern of electrical charges—an electrostatic latent image. The system can also work with either a more positively charged electrostatic latent image on a more negatively charged background, or on a more negatively charged electrostatic latent image on a more positively charged background.

The printer's laser or laser scanning assembly draws the image to be printed on the photoreceptive drum. A known laser scanning assembly may include a laser, a movable mirror, and a lens. The laser receives the image data defined by pixels that make up the text and images one horizontal line at a time. As the beam moves across the drum, the laser emits a pulse of light for every pixel to be printed. Typically, the laser does not actually move the beam. Instead, the laser reflects the light beam off a movable mirror. As the mirror moves, the light beam passes through a series of lenses. This system compensates for the image distortion caused by the varying distance between the mirror and points along the drum. The laser assembly moves in one plane horizontally as the photoreceptor drum continuously rotates, so the laser assembly can draw the next line. A print controller synchronizes this activity. In the process of forming the latent image on the photoreceptive drum, the laser discharges those areas where the latent image is formed.

When the toner becomes electrostatically charged, the toner is attracted to exposed portions of the image transfer drum. After the data image pattern is set, charged toner is supplied to the photoconductive drum. Because of the charge differential, the toner is attracted to and clings to the discharged areas of the drum, but not to the similarly charged "background" portions. Toner is an electrostatically charged powder with two main ingredients, pigment, and plastic. The pigment provides the coloring, such as black in a monochrome printer, or cyan, magenta, yellow, and black in a color printer, and forms the text and images. The pigment is blended with plastic particles so the toner will melt when passing through the heat of a fuser assembly. The toner is stored in a toner cartridge housing, a small container built into a removable casing. The printer gathers the toner from a sump within the housing and supplies it to a developer unit using paddles and transfer rollers. The developer roll is a charged rotating roller, typically with a conductive metal shaft and a polymeric conductive coating, which receives toner from a toner adder roll positioned adjacent the developer roll. Due to electrical charge and mechanical scrubbing, the developer roll collects toner particles from the toner adder roll. A doctor blade assembly engages the developer roll to provide a consistent coating of toner along the length and surface of developer roll by scraping or "doctoring" excess toner from the developer roll. The doctor blade may also induce a charge on the toner. This, in turn, provides a consistent supply of toner to the photoconductive drum. When the coating of toner on the developer roll is inconsistent, too thick, too thin, or bare, the coating of the photoconductive drum is inconsistent, and the level of darkness of the printed image may vary due to these inconsistencies. This condition is considered a print defect.

The electrostatic image on the photoconductive drum is charged such that the toner particles move from the developer roll onto the latent image on the photoconductive drum to create a toned image on the photoconductive drum. The toned image is transferred from the photoconductive drum to a printable medium such as paper or onto a intermediate transfer belt which then transfers the toned image onto the printable medium. The paper or transfer belt is oppositely charged to the toner, causing it to transfer to the paper or transfer belt. This charge is stronger than the charge of the electrostatic image, so the paper or belt pulls the toner particles away from the surface of the photoconductive drum. Since it is moving at the same speed as the drum, the paper or transfer belt picks up the image pattern exactly.

One problem that often occurs in a laser printer or other image-forming device is toner leakage. Toner from the sump can leak into the toner cartridge and interfere with the proper operation of the unit. One significant area of toner leakage is a path along portions of the developer roll where a J-seal, positioned proximate both ends of the developer roll, slidably engages the developer roll, particularly where the developer roll, doctor blade, and J-seal all meet. These locations are difficult to seal due to the tolerances, stiffness, and deflections of the aforementioned components. Observations of operational toner pressure as well as vibration and drop testing have demonstrated that the areas around the surface of the developer roll and the J-seal are a frequent toner leak path, especially in higher volume housings.

The interface between the developer roll and the J-seal, identified on the developer roll as the "clean band," creates heat inside the toner cartridge when the developer roll turns. Friction is unavoidable with current designs because the J-seal must contact the developer roll around its periphery at all times. The J-seal interface is a source of high friction because the J-seal must be made from a pliable material in order to securely contain the toner in the cartridge. The J-seal interface contacts the developer roll, which is frequently covered by a polymeric or rubberized material with a high coefficient of friction. It will be appreciated that the temperature of the developer roll along its length is significantly higher at the clean bands than it is at intermediate positions due to friction with the J-seal.

One solution to excessive heat from the J-seal interface has been to apply a lubricant to the clean band area in an attempt to decrease the coefficient of friction. However, such an approach has significant drawbacks. Any lubricant applied to the J-seal or to the ends of the developer roll can potentially contaminate the toner and ruin any printed image. Additionally, the lubricant can seep into other areas of the cartridge or printer, causing unwanted damage and interfere with the proper operation of the unit.

Another solution to excessive heat from the J-seal has been to utilize directed airflow, such as from a fan, to blow air across the entire length of the developer roll. However, this had been found to be ineffective in lowering the temperature of the developer roll by any significant amount.

In addition, the heat created by the friction at the J-seal interface causes further problems with the proper operation of a laser printer or other image-forming device as print speed increases. Since it is essential to maintain pressure between the J-seal and the developer roll, more heat is created as the print speed increases. In known printers, a print speed of 35 pages per minute (ppm) is slow enough that, even with continuous printing, the heat created at the J-seal can be dissipated into the surrounding cartridge parts and into the atmospheric air to prevent heat related failure. In such an instance, the toner cartridge can reach a thermal equilibrium and still operate properly with undirected machine airflow as a cooling method. However, printing at higher speeds such as at or above 50 ppm causes extreme overheating, which is localized at the ends of the developer roll around the J-seal interface. Low thermal conductivity of the developer roll worsens the heating condition, and a large temperature gradient can be created around the clean bands in the axial direction of the developer roll.

It will be appreciated that high temperatures negatively affect the ability of the J-seal to seal toner inside the cartridge. As heat from the clean band areas increases, the temperature of the surface of the developer roll increases, and the temperature of the toner in the immediate region also increases. Temperatures of up to 70° C. around the J-seal interface have been measured when a printer was operated at 50 ppm. For some toners, fusing can occur at approximately 46° C. Thus, it will be appreciated that toner fusing may occur in the area of contact between the J-seal and the developer roll when the image forming device is operated at speeds of 50 ppm or higher. In such an instance, the J-seal contacts an irregular layer of fused toner on the developer roll, and not an extremely smooth surface, which is the most desirable condition in order to achieve a consistent and reliable seal. This condition allows toner to escape past the J-seal and out of the toner cartridge.

Once toner leakage at the J-seal begins, toner loss almost always continues at a rapid rate, permitting several grams of toner per minute to escape into the printer. Such large amounts of toner losses are substantial enough to severely affect cartridge yield, and may result in yields of several thousand pages fewer than expected. In addition, major print defects occur, as the escaped toner from the toner cartridge can spill directly onto the transfer belt near the location of the first transfer or onto the print media.

SUMMARY OF THE INVENTION

In accord with the present invention, a cartridge for containing toner material used in an image forming device comprises a developer roll, a seal providing an interface with the developer roll and the toner, and an air duct for conducting air flow across the interface to cool the developer roll.

Further in accord with the present invention, an air duct in a cartridge for containing toner material, a developer roll, and a seal providing an interface with the developer roll, the developer roll having a distal end and a proximal end, with one seal located at each of the distal and proximal ends, comprises an elongated hollow body, a pair of nozzles in fluid communication with the hollow body, one of the nozzles being disposed at the distal end of the developer roll and the other of the nozzles being disposed at the proximal end of the developer roll.

Still further in accord with the present invention, in an image forming device having a cartridge for containing toner material, a developer roll, and a J-seal providing an interface therebetween, the improvement comprises an air duct disposed adjacent the developer roll for conducting air flow across the J-seal interface to cool the developer roll and J-seal.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
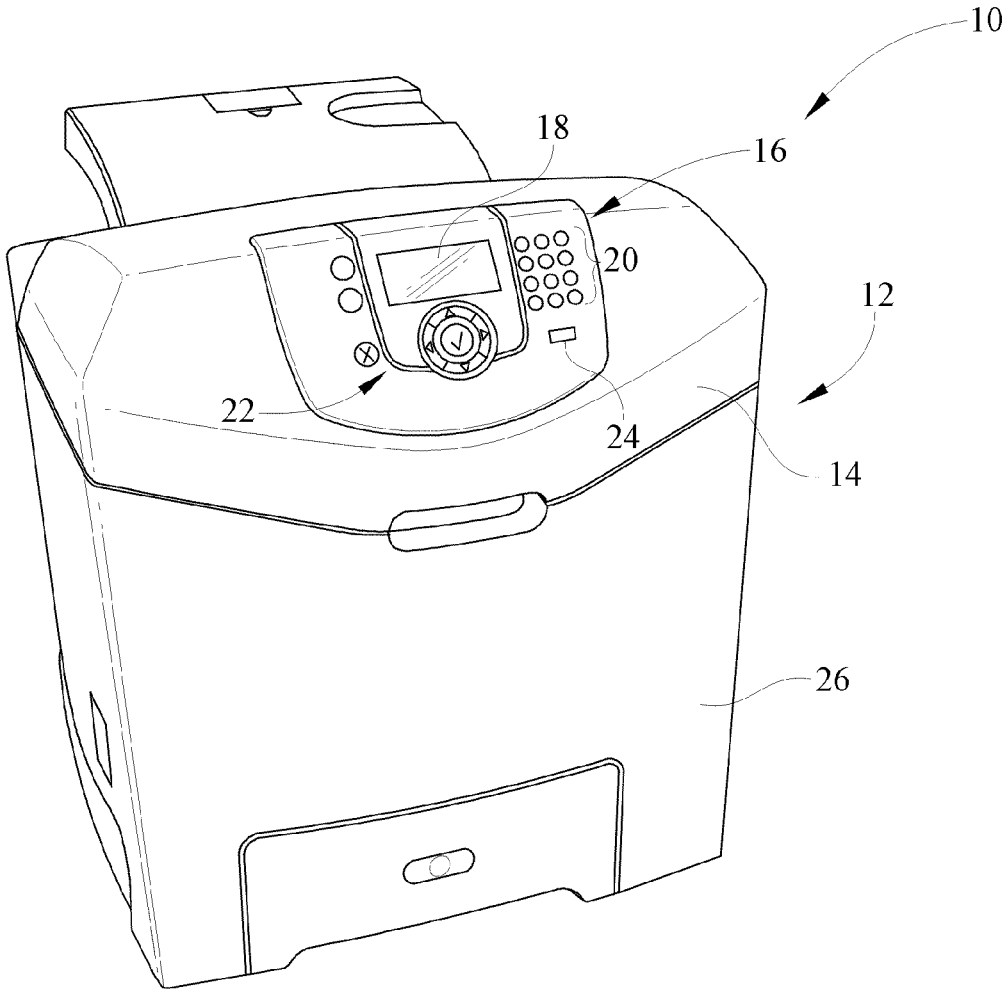
FIG. 1 is a perspective view of an exemplary electrophotographic printer.
Figure 6:
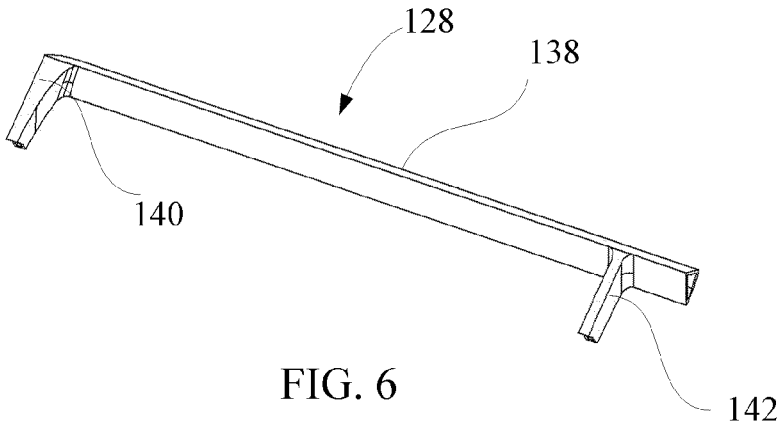
FIG. 6 is a perspective view of the air duct of FIG. 5.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 2:
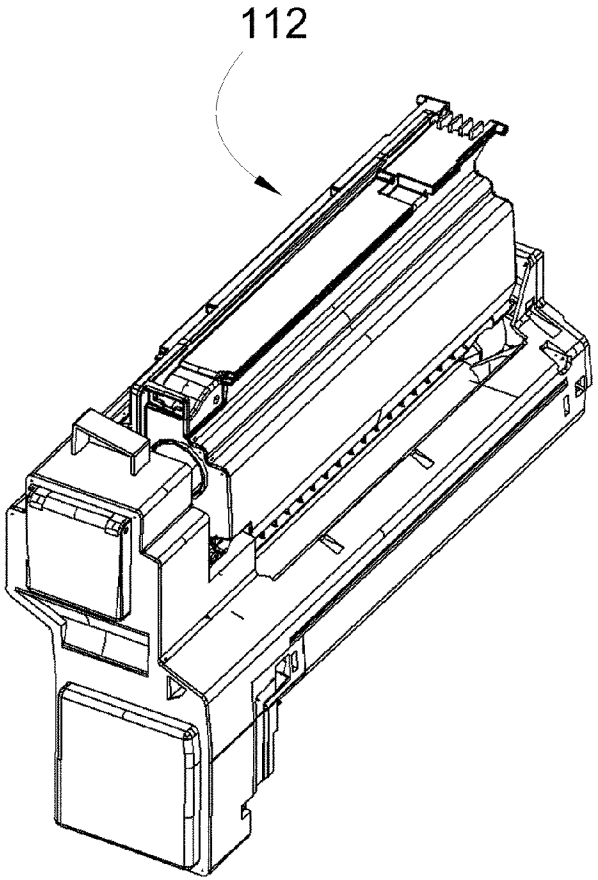
FIG. 2 is a perspective view of a toner cartridge used in the electrophotographic printer of FIG. 1.
Figure 3:
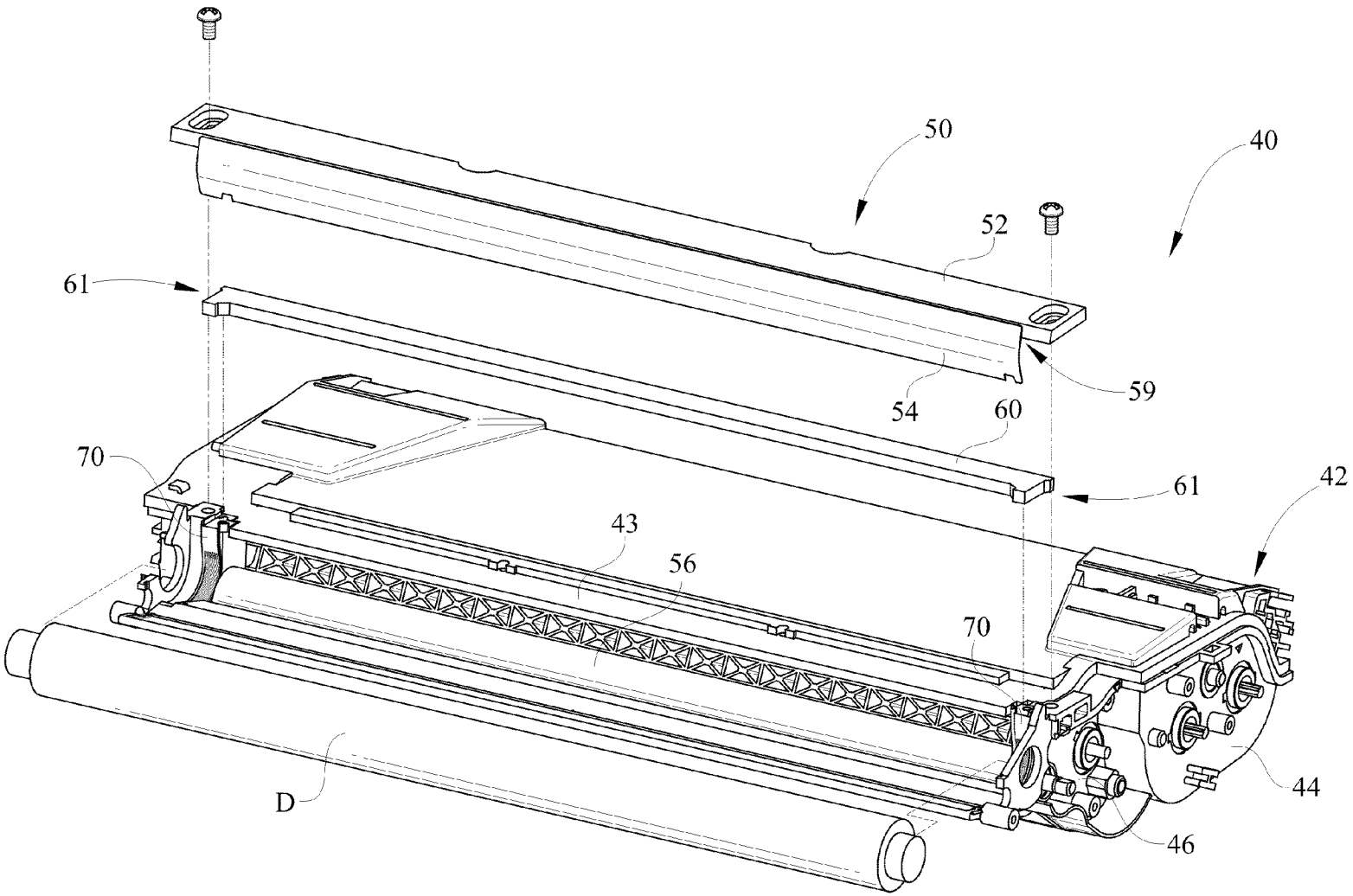
FIG. 3 is a partially exploded perspective view of a developer assembly.

Referring now to FIG. 1, a perspective view of a peripheral device 10 having a laser printing mechanism is depicted in perspective view. Although the peripheral device 10 is depicted as a laser printer, one skilled in the art should realize that the present design may alternatively be used with an all-in-one device, copier, fax, stand-alone device or the like having an electrophotographic (laser) print engine. The exemplary peripheral device embodied by the laser printer 10 comprises a housing 12 including a primary access door 14 positioned on the top-front of the housing 12. The housing 12 generally comprises a front surface, first and second side surfaces, a rear surface (not shown) and a bottom surface to enclose the laser printer operating mechanisms. On the front of the housing 12, the primary access door 14 is pivotally mounted to allow opening and access for installation or removal of a developer assembly 40 (FIG. 3). The front panel of the primary access door 14 comprises an operations panel 16 that includes a display 18, an alpha numeric keypad 20, a plurality of selection buttons 22, as well as a flash memory slot 24. The operations panel 16 is in electronic communication with a controller (not shown), which may be embodied by one or more microprocessors, in order to operate the laser printer 10. Beneath the primary access door 14 is a secondary access door 26 that allows access to the developers or toner cartridges 112 (See FIG. 2). The printer 10 may operate in both monochrome and color. In the later instance, for example, three additional toner colors may be utilized to provide the color printing, comprising the toner colors cyan, yellow, or magenta, although other colors may be utilized.

Referring now to FIG. 3, a developer assembly 40 is depicted in perspective view. The developer assembly 40 comprises a housing 42, formed of a first housing portion 44 and a second housing portion 46. Along at least one side of the housing 42 is a lid 43. Within the first housing portion 44, toner is stored, and at least one paddle is located therein on a rotating shaft to move the toner from the first housing portion 44 toward the second housing portion 46. A toner adder roll 56 is located within or adjacent to the second housing portion 46, and receives toner therefrom. The toner adder roll 56 coats the developer roll D with toner, which is scraped or "doctored" by the doctor blade 54 to form an even layer of toner on the developer roll D, and in turn supplies toner to the imaging or photoreceptive drum. A seal assembly 70 inhibits leakage of toner between the developer housing 46 and the corner 59 formed by the doctor blade bracket 52 and the doctor blade 54 when it is dropped, and also during operation when the developer assembly 40 vibrates and creates internal pressures.

The developer assembly 40 includes J-seals 70 at the ends of the developer roll D. The developer roll D is exploded in FIG. 3 for clarity, so that the J-seals 70 may be seen. The J-seals 70 are substantially J-shaped to receive the developer roll D, although other curvilinear shapes may be utilized. The J-seals 70 are as described U.S. patent application Ser. No. 11/959,016, entitled UPPER SEAL FOR INHIBITING DOCTOR BLADE TONER LEAKAGE, and U.S. patent application Ser. No. 11/959,058, entitled DEVELOPER ROLL LIP SEAL, both filed Dec. 18, 2007, all assigned to the assignee of this application, and incorporated herein by reference. The upper portion of the J-seal 70 is slightly curved substantially to match the deflected shape of the blade 54. The lower portion of the J-seal 70 is curved to receive the developer roll D. Disposed above the J-seal 70 is a doctor blade seal 60, which extends in a length that is parallel to the axial dimension of the developer roll D. Also disposed above the J-seal 70 is a doctor blade bracket assembly 50 comprising at least one first bracket 52 and the doctor blade 54. Like the doctor blade seal 60, the doctor blade bracket assembly 50 also extends in a direction that is substantially parallel to the axial dimension of both the toner adder roll 56 and developer roll D. The doctor blade seal 60 is captured between the doctor blade bracket assembly 50 and the J-seal 70 or the lid 43. The doctor blade 54 engages the developer roll D to scrape excess toner from the surface of the developer roll D, which provides a consistent level of toner to the imaging or photoreceptive drum of the printer 10. The doctor blade seal 60 is seated on the J-seals 70 to inhibit leakage of toner near the ends of the developer roll D and between the lid 43 and the developer housing 42. The doctor blade bracket assembly 50 compresses the doctor blade seal 60 to improve sealing in this area.

Figure 4:
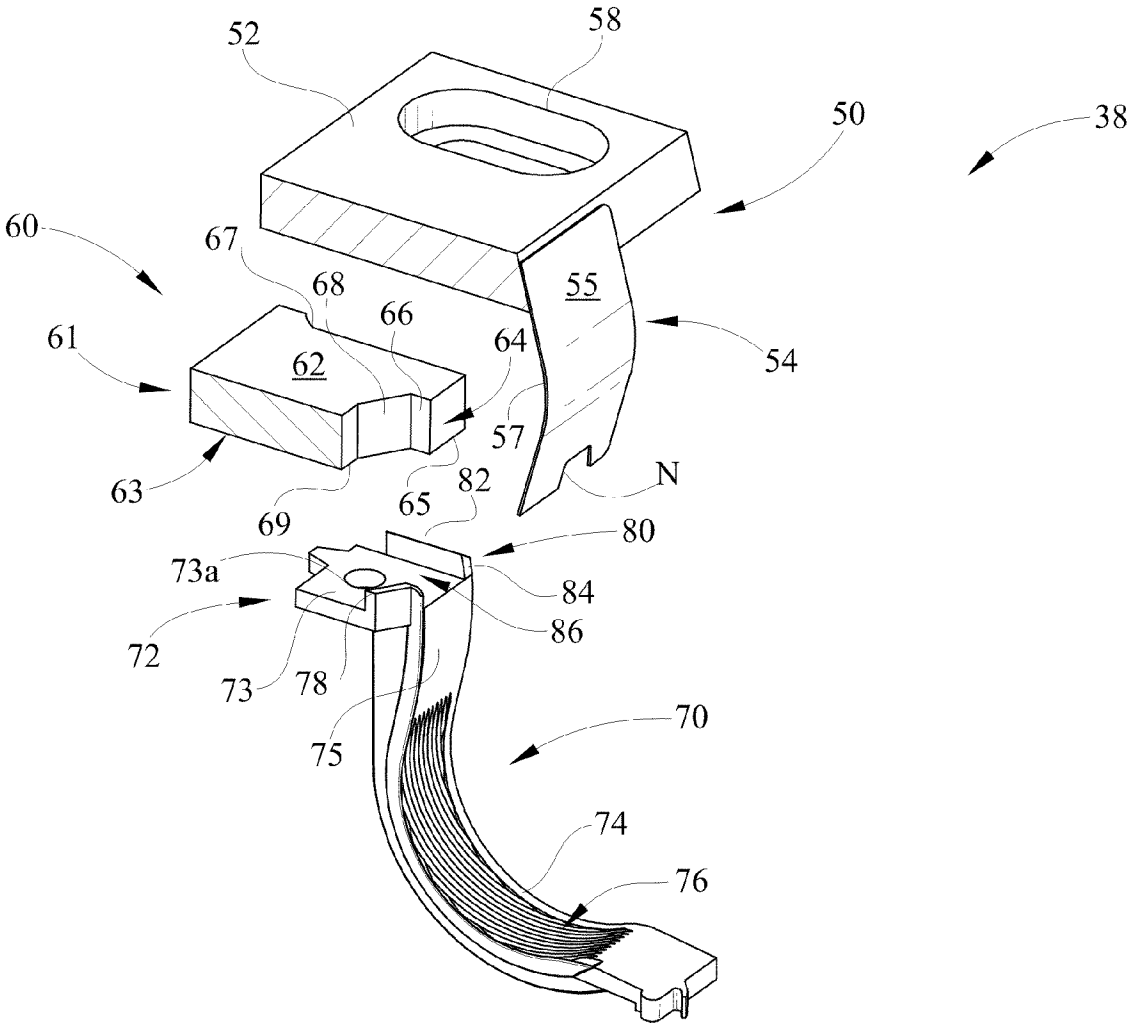
FIG. 4 is an exploded perspective view of a developer seal assembly.

Referring now to FIG. 4, an exploded perspective view of the seal assembly 38 is depicted. The doctor blade bracket assembly 50 and the doctor blade seal 60 are cut in section for purpose of clarity. As previously indicated, the doctor blade bracket assembly 50 is disposed above the doctor blade seal 60 that is positioned above the J-seal 70. The doctor blade bracket assembly 50 comprises a bracket 52 and a blade 54 connected to the bracket 52. The blade 54 is welded to the bracket 52. However, the bracket 52 may be connected to the blade 54 by a fixative such as epoxy, cement, glue, or the like. The blade 54 may also be connected to the bracket 52 by a fastener, or the blade 54 may be captured or sandwiched between first and second bracket members. The bracket 52 includes an aperture 58 for connection of the doctor blade bracket assembly 50 to the housing 42. The aperture 58 is oval in shape so as to provide an adjustment for the blade 54 toward or away from the developer roll D. The bracket 52 is generally a stiff material such as steel and rectangular in shape extending from one side of the housing 42 to an opposed side of the housing 42. The bottom surface of the bracket 52 is generally smooth so as to engage the upper surface of the doctor blade seal 60.

The blade 54 extends from the bracket 52 toward a peripheral surface of the developer roll D in order to scrape excess toner from the outer surface of the developer roll D. The blade 54 is generally rectangular in shape, having a long or widthwise dimension substantially parallel to the direction of the axial dimension of the developer roll D. The blade 54 includes a front surface 55 and a rear surface 57. The blade 54 is straight in its natural state, but, in order to provide a "doctoring" force on the developer roll D, has a slight curvature due to interference with the developer roll D upon installation. In addition, the blade 54 has notches N near ends of the blade for removing all toner from the ends of the developer roll D where printing does not occur. The blade 54 may also receive an electrical potential in order to charge the developer roll D with a desired polarity during operation. The lower surface of the bracket 52 engages an upper surface 62 of the doctor blade seal 60, so as to capture the seal 60 between the doctor blade assembly 50 and the J-seal 70. The blade 54 may be formed of phosphor bronze to provide the desired elasticity and electrical conductivity, or alternatively, may be formed of a hardened stainless steel to provide a desired elasticity and also withstand corrosion that might damage the developer roll D. Other materials may also be utilized.

An end portion 61 of the doctor blade seal 60 is shown above one of the J-seals 70. The doctor blade seal 60 has first and second ends 61 (FIG. 3). As previously described, the doctor blade seal 60 extends between the ends 61 in a direction generally parallel to the axial dimension of the developer roll D and the toner adder roll 56. The doctor blade seal 60 is formed of a foam material to act as a deformable seal between the bracket assembly 50 and the J-seal 70 or the lid 43, as well as around the housing 42 adjacent the J-seal 70 and between the bracket 52 and the blade 54. The ends 61 are positioned on an upper seat surface 73 of the J-seal 70. The portion of the doctor blade seal 60 between the ends 61 is supported by the lid 43 of the housing 42 (FIG. 3).

The doctor blade seal 60 has the upper surface 62, a lower surface 63 and a plurality of sides extending between the upper and lower surfaces 62, 63. Along the front of the doctor blade seal 60, toward the doctor blade 54, a tongue 64 is integrally formed with and extends from the doctor blade seal end 61. On an outer end of the tongue 64 is a tongue end surface 65 of the doctor blade seal 60. Perpendicular to tongue end surface 65 of the tongue 64 near the blade 54 is a tongue-extending surface 66. Angled from the tongue-extending surface 66 is an angled or tapered surface 68. The angled surface 68 joins the tongue-extending surface 66 and a front seal surface 69, which extends the distance of the doctor blade seal 60 to the opposite end 61 (not shown) of the doctor blade seal 60. Therefore, the tongue 64 generally extends from the angled surface 68 in a direction substantially perpendicular to the front seal surface 69. In combination, the surfaces 69, 68, 66 define a recess wherein an upper seat inner seal wall 78 of the J-seal 70 is received. An end wall 67 is indented and is received against upper seat outer seal wall 82. As previously indicated, the doctor blade seal 60 extends in a width-wise direction, which corresponds to the width of a media sheet, and perpendicular to the media feed path direction to an opposite end of seal 60.

Beneath the doctor blade seal 60, the J-seal 70 comprises an upper seat portion 72, and a developer roll leg 74, which is substantially j-shaped and depends from the upper seat portion 72. The J-seal 70 may be formed in a molding process, such as injection molding, compression molding, or other known processes for forming a plastic, such as a thermoplastic rubber having the trade name SANTOPRENE. The leg 74 has a front surface 75 comprising a plurality of grooves 76, which provide several functions. The grooves 76 "snowplow" the toner on the developer roll D and capture toner between the grooves to inhibit leakage. The grooves 76 also direct the toner toward a storage area via rotation of the developer roll D (FIG. 3). The grooves 76 are disposed at an angle, which may be from about zero to about forty-five degrees from the sidewall of the leg 74.

The upper seat portion 72 comprises a seating surface 73, the upper seat inner seal or seal wall 78, and an upper seat outer seal or seal wall 80. A gap 86 is disposed between the upper seat inner seal 78 and the upper seat outer seal 80, wherein the tongue 64 may be closely received within the upper seat portion 72 to interlock the J-seal 70 and the doctor blade seal 60. The seating surface 73 also comprises an aperture 73*a* made for receiving an alignment pin for proper positioning of the J-seal 70 to the housing 42.

The upper seat inner seal wall 78 extends upwardly from the upper seat surface 73. The upper seat inner seal 78 is disposed at an acute angle with respect to the outer seal 80, which corresponds to that of the angled surface 68, so that the upper seat inner seal 78 and angled surface 68 engage one another in sealing fashion. Further, the upper seat inner seal 78 is received within the recess defined by the surfaces 66, 68, 69.

As is known, the laws of heat transfer provide three basic ways to move heat from one location to another: convection, conduction, and radiation. In the case of a laser printer 10 such as the one depicted in FIG. 1, convection is the most efficient way to remove heat. The limited space inside the laser printer 10 eliminates many possibilities to conduct heat away from the developer roll D. The developer roll D is relatively thick and a relatively poor conductor of heat, so the developer roll D supports very little heat transfer. The matching components of the developer roll D are, in the preferred embodiment, made of plastic molded parts, which are also relatively poor conductors of heat. Since the space allotted inside the laser printer 10 is reduced in an effort to produce a compact size, there is little room inside the toner cartridge 112 for additional components. Cooling by radiation inside the cartridge 112 is not feasible because the highest operating temperature inside the toner cartridge 112 is generally not high enough to realize a measurable benefit.

Figure 5:
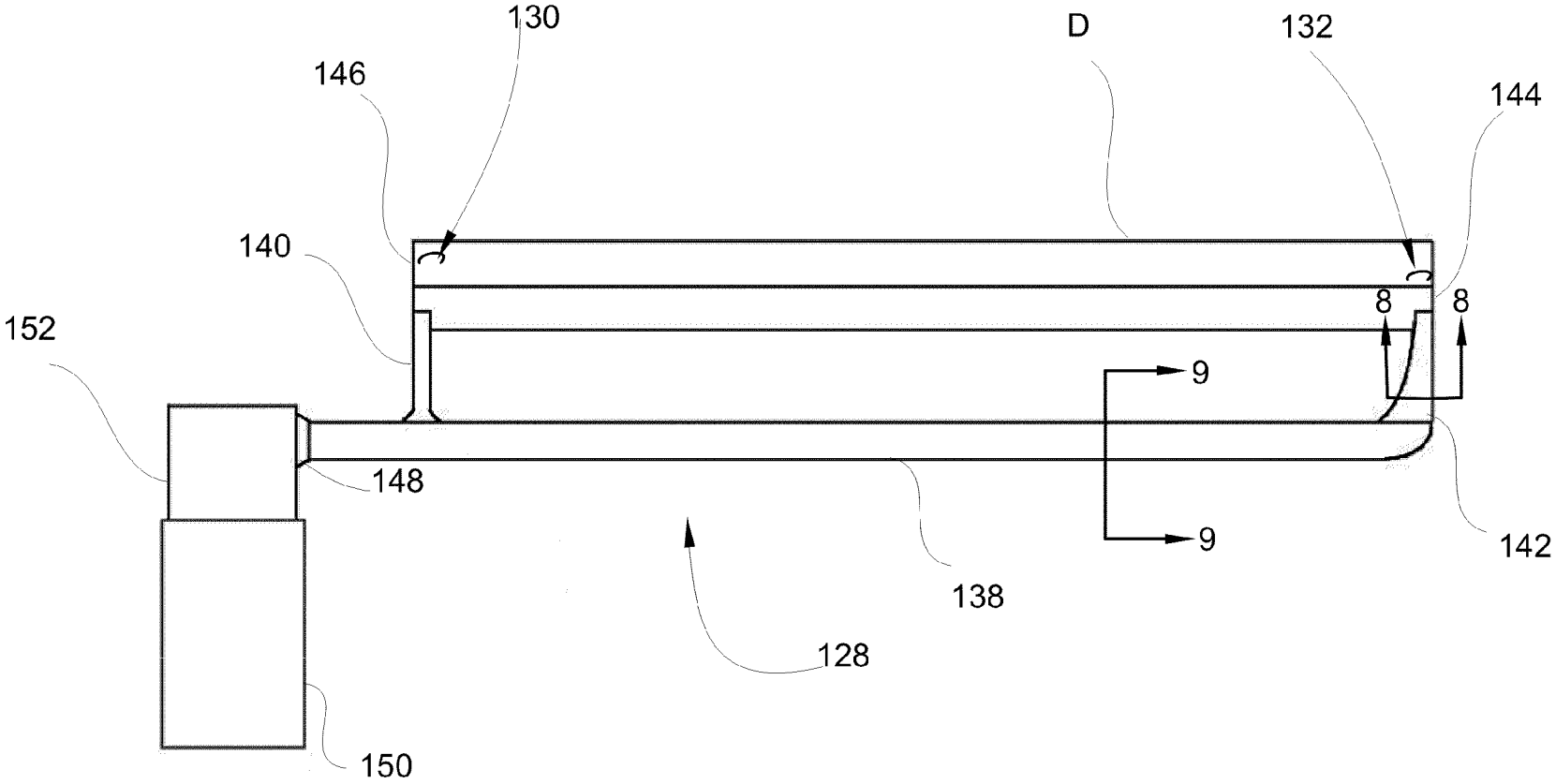
FIG. 5 is a perspective view of an exemplary air duct and a developer roll in the toner cartridge of the present invention.

Turning now to FIG. 5, an air duct 128 is disposed within toner cartridge 112 adjacent the developer roll D and directs air onto proximal and distal clean bands 130, 132 of the developer roll D through proximal and distal nozzles 140, 142. The equation giving the heat transferred by convection is $$q=hA\Delta T \qquad \text{(Equation 1)}$$

where q=heat transfer rate h=heat transfer coefficient

A=surface area

ΔT=temperature difference between surface and ambient air

As is evident from Equation 1, greater heat transfer occurs with increasing temperature difference. In the case of the developer roll D, the temperature difference between ambient air and the surface of the developer roll D is much greater at the clean bands 130, 132 than across the other portions of the developer roll D. Also, the heat transfer coefficient, h, increases with air velocity. It will thus be appreciated that the most effective cooling of developer roll D occurs when the air blown onto the clean bands 130, 132 occurs at the highest possible velocity.

The air duct 128 carries ambient air through the toner cartridge 112 and directs it onto the proximal and distal ends 146, 144 of the developer roll D, without obstructing the laser path through the printer 10, in order to maximize the air velocity at the clean bands 130, 132. The equation determining the flow through the air duct 128 is known as the Bernoulli equation, and describes the operating conditions at any point in a straight duct where the flow is steady and friction is neglected.

$$p + \frac{1}{2}\rho v^2 + \rho gh = const \qquad \text{(Equation 2)}$$

where p=pressure at any point in the duct

ρ=density of the material inside duct (in this case, air)

v=velocity inside the duct at the point in question g=gravitational force at the point h=height of the point in question Since the Bernouilli Equation (Equation 2) describes any point in the air duct 128, the density of the air inside the air duct 128 is approximately constant, and the height at every point inside the air duct 128 is approximately zero. The Bernoulli Equation (Equation 2) can thus be simplified to relate the air velocity at the inlet and exit of the air duct 128 for a given pressure difference, and the resulting equation is $$v_2 = \sqrt{v_1^2 + \frac{2\Delta p}{\rho}} \quad \text{(Equation 3)}$$

where v1=pressure at duct inlet v2=pressure at duct exit

ρ=density of air

Δp=pressure difference between inlet and exit (operating pressure difference provided by the fan)

From Equation 3, one of skill in the art will recognize that increasing the pressure difference across the air duct 128 increases the exit velocity. However, increasing the pressure difference across the air duct 128 provides a lower flow rate.

Figure 9:
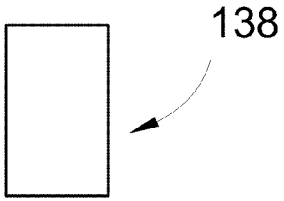
FIG. 9 is a cross section taken along the lines 9-9 of the air duct of FIG. 5.
Figure 10:
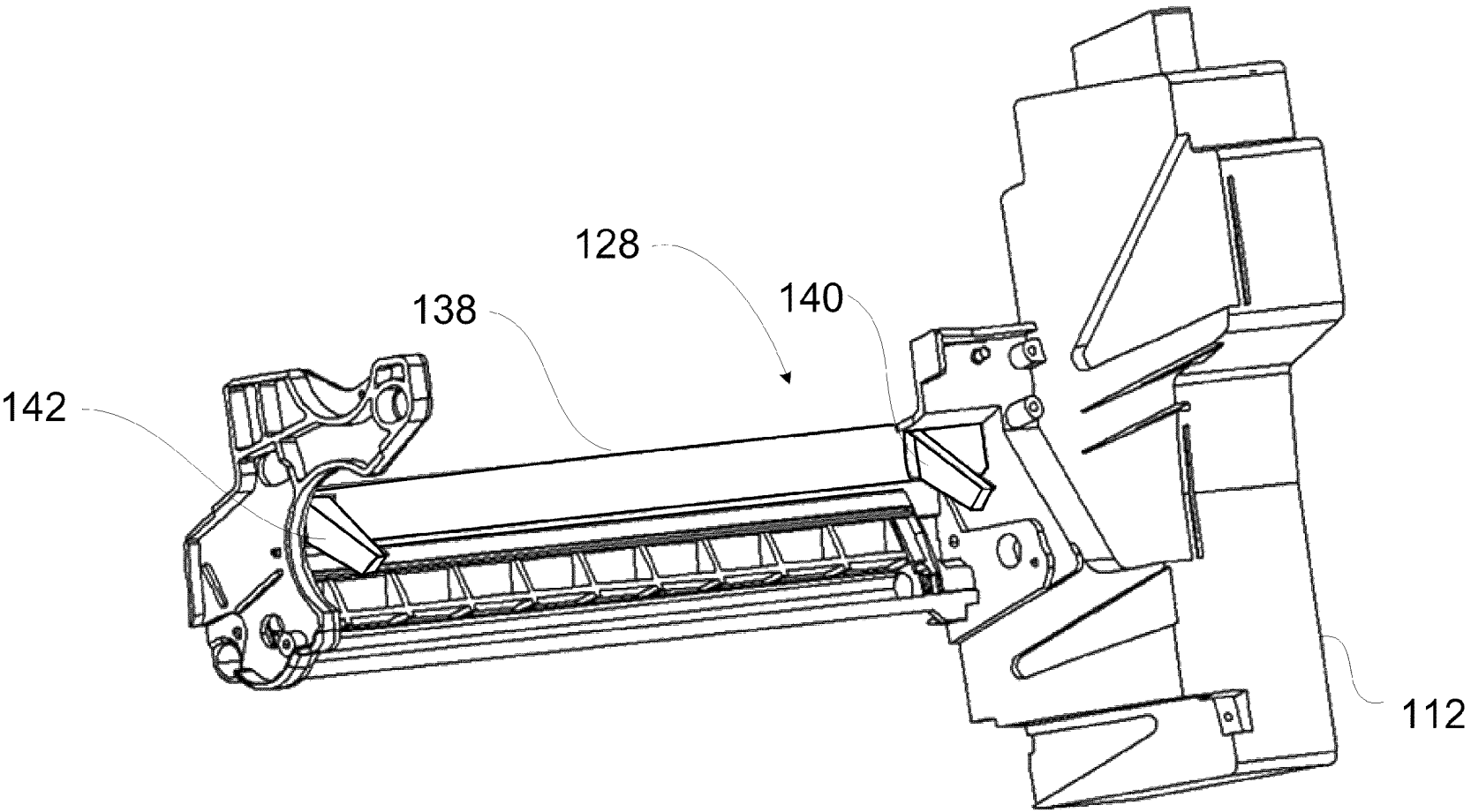
FIG. 10 is a perspective view of an exemplary toner cartridge cutaway to reveal the air duct of FIG. 6.

Referring now to FIGS. 5 to 10, the air duct 128 in the toner cartridge 112 is a unitary structure that comprises a hollow elongated body portion 138 and a pair of nozzles in fluid communication with the interior of body portion 138, the distal nozzle 142 and the proximal nozzle 140. It will be appreciated from FIG. 5 that the distal nozzle 142 is located adjacent a distal end 144 of the developer roll D, while the proximal nozzle 140 is located adjacent a proximal end 146 of the developer roll D. The elongated body portion 138 of the air duct 128 has an inlet that is in fluid communication with a manifold or neck portion 148. The manifold 148 is in fluid communication with air from a fan or other air blower 150 located in the laser printer 10. The fan 150 provides air at a predetermined velocity to the elongated body portion 138 and to the proximal and distal nozzles 140, 142. Air from the proximal and distal nozzles 140, 142 flows across proximal and distal clean bands 130, 132 of the developer roll D adjacent the distal and proximal ends 144, 146 thereof. The manifold 148, in the illustrated embodiment, has only a single developer roll D and a single air duct 128, such as would be found in a monochrome laser printer 10. In the alternate embodiment of FIG. 13, as discussed more fully hereinbelow, the manifold 148 connects multiple developer rolls D via a plenum portion 152, and provides fluid communication with the fan or air blower 150. In FIG. 10, the air duct 128 is shown positioned and inserted within the toner cartridge 112. Proximal and distal nozzles 140, 142, are directed at distal and proximal ends 144, 146 of developer roll D and seals 70 when developer assembly 40 (see FIG. 3) is installed in toner cartridge 112.

Figure 8:
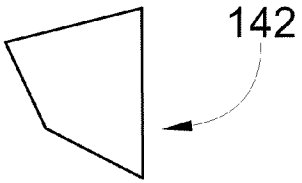
FIG. 8 is a cross-section taken along the lines 8-8 of the air duct of FIG. 5.
Figure 7:
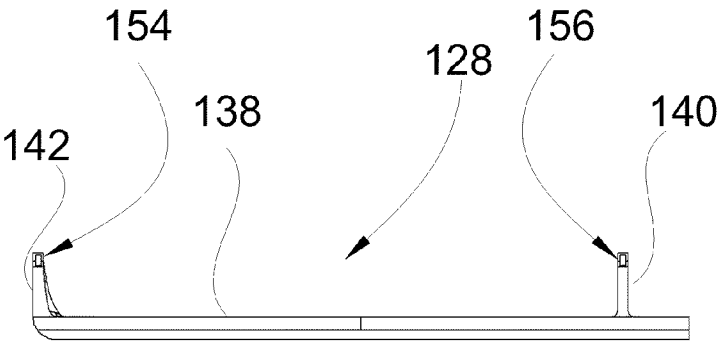
FIG. 7 is a bottom plan view of the air duct of FIG. 6.

With reference to FIGS. 5 and 8, the proximal and distal nozzles 140, 142 generally taper in an axial manner in a direction away from the elongated body portion 138. A cross section of the distal nozzle 142 has an irregular quadrilateral shape. It will be appreciated that the cross section of the proximal nozzle 140 is a mirror image of the cross section of the distal nozzle 142. With reference to FIGS. 5 and 9, the elongated body portion 138 has a generally substantially regular rectangular cross section along its axial length. It will be appreciated that the air duct 128 provides airflow from the fan 150 across the distal and proximal clean bands 130, 132 to cool the developer roll D. As illustrated in FIG. 7, the proximal and distal nozzles 140, 142 have openings 156, 154 for the air from the fan 150 to exit across the clean bands 130, 132. The tips of the proximal and distal nozzles 140, 142, where the openings 156, 154 are located, do not contact clean bands 130, 132 of the developer roll D, but are in close proximity thereto so that the air therefrom may blow across the developer roll D.

Figure 11:
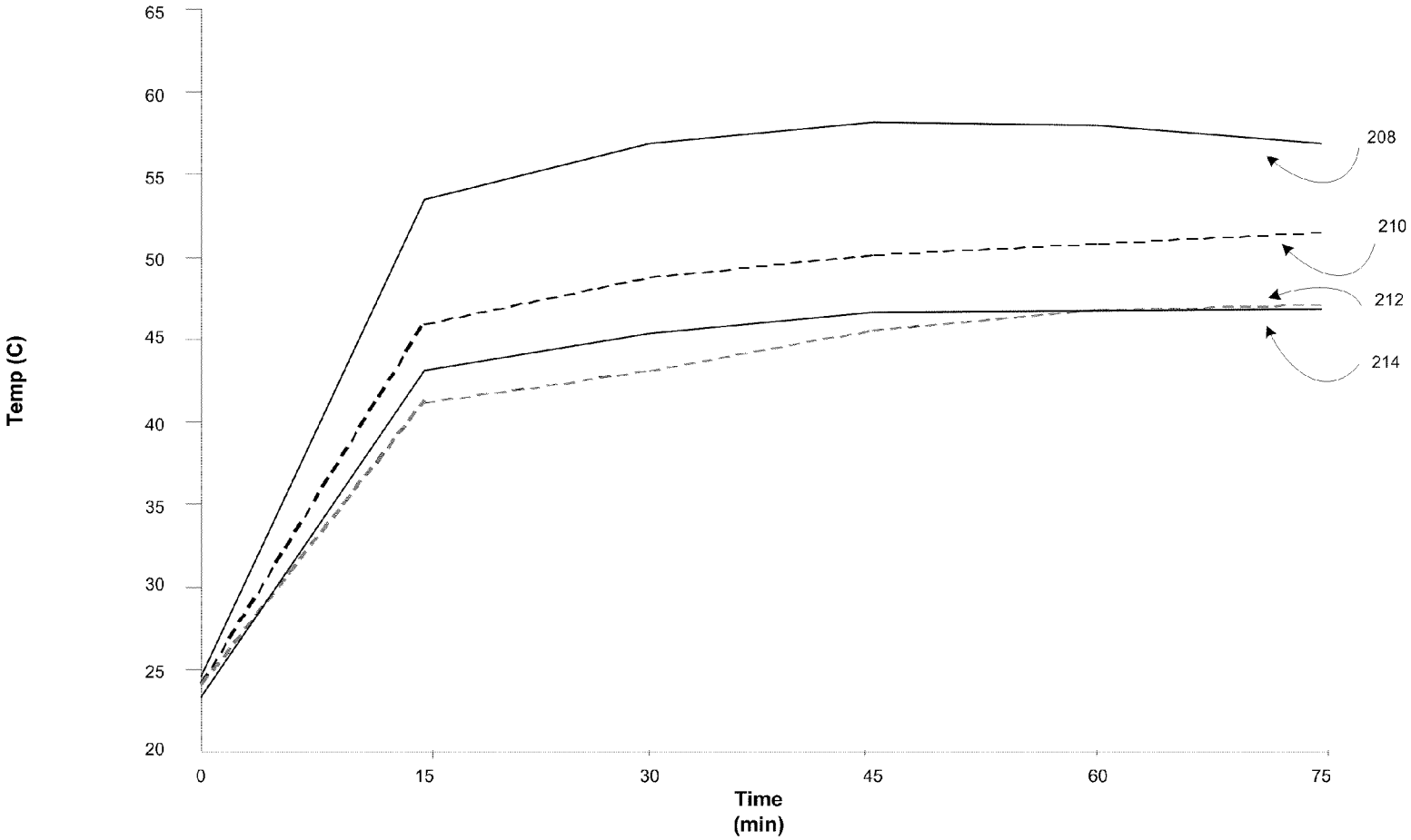
FIG. 11 is a graph illustrating the temperature of a seal used in the toner cartridge of the present invention.
Figure 12:
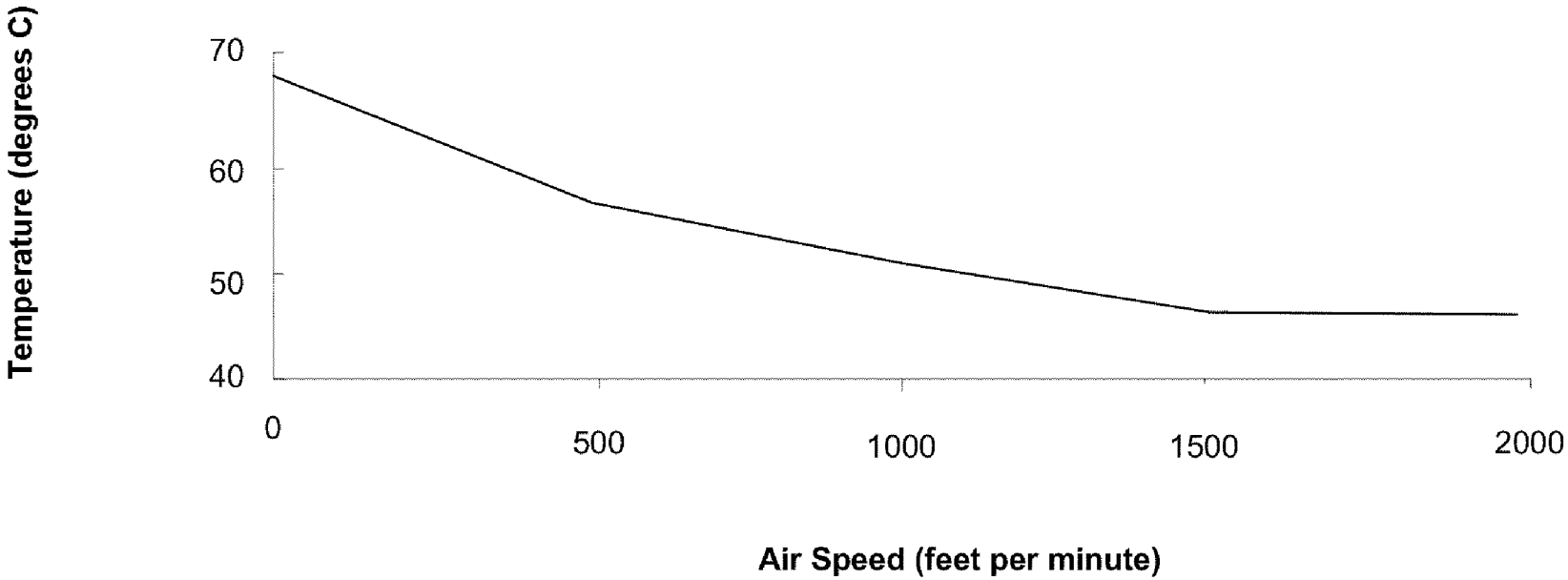
FIG. 12 is a graph illustrating air speed versus temperature as measured in the toner cartridge of the present invention.
Figure 13:
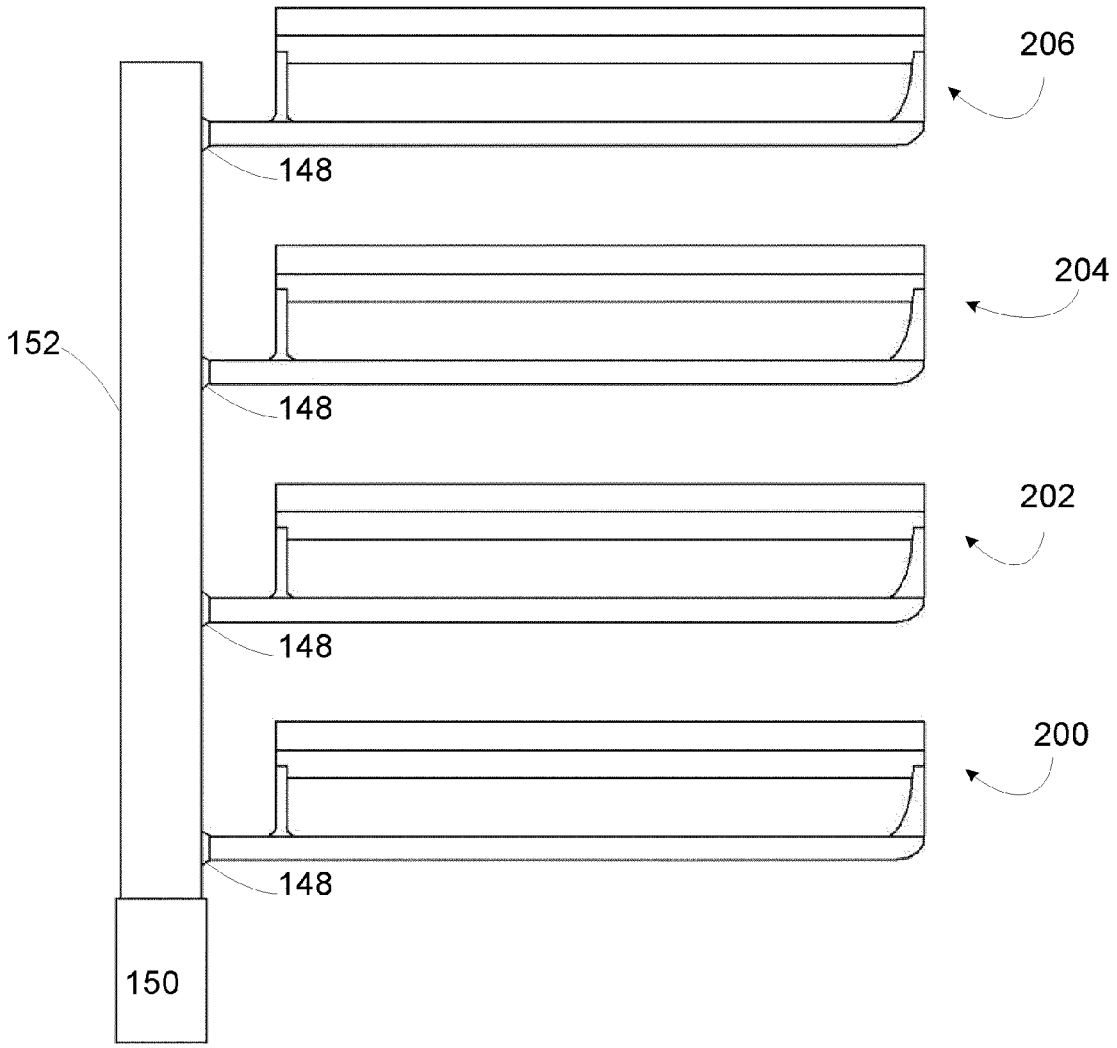
FIG. 13 is a perspective view of an alternate embodiment of the toner cartridge of the present invention.

Referring now to FIGS. 11 to 13, a test was conducted by blowing a narrow stream of air, approximately the same width as the proximal and distal clean bands 130, 132, onto the developer roll D as it is configured in a developer unit from a model C782 color printer available from Lexmark International, Inc., turning at a rate corresponding to a speed of 50 ppm. This test, as illustrated in FIGS. 11 and 12, verified that the surface temperature of the developer roll D drops with increasing air speed. The developer roll D was enclosed so that no ambient air was allowed to pass over the developer roll D. All temperature differences achieved were the direct result of the airflow exiting from the air duct 128. The results of the test are depicted in the graph of FIG. 12, which illustrates that for increasing air speeds, the temperature of the developer roll D cools with increasing air velocity.

FIG. 13 illustrates an embodiment of the present invention in a color laser printer that was used in the test, and included four air ducts 200, 202, 204, 206 with the same geometry and spacing as depicted in FIGS. 5 to 9. The air ducts 200, 202, 204, 206 were in fluid communication with the fan 150. In FIG. 11, curve 208 represents the temperature of the J-seal 70 at 750 feet per minute (fpm); curve 210 represents the temperature at 1000 fpm; curve 212 represents the temperature at 1500 fpm; and curve 214 represents the temperature at 2000 fpm. FIG. 12 illustrates that the air flow from the air ducts 200, 202, 204, 206 asymptotically reduced the operating temperature of the developer roll D from 68° C. to 46° C., when measured 2 mm from the end of the back of the blade 54 as the air speed increased to 1500 fpm and higher with only a slight decrease in temperature occurring at higher air speeds.

The foregoing description of embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A cartridge for containing toner material used in an image forming device comprising:

a developer roll;

a seal providing an interface with said developer roll and said toner; and an air duct in said cartridge for conducting airflow across said interface to cool said developer roll and seal, said air duct comprising:

an elongated body; and a pair of nozzles in fluid communication with said elongated body, said pair of nozzles each being tapered in an axial direction and having an irregular quadrilateral cross-section.

2. The cartridge of claim 1, wherein said elongated body of said air duct has a substantially regular rectangular cross-section.

3. The cartridge of claim 2, wherein said elongated body of said air duct has a neck portion for fluid communication with an air blower.

4. The cartridge of claim 1, further comprising an air blower in fluid communication with said air duct for forcing air through said air duct to cool said developer roll.

5. The cartridge of claim 1, wherein said developer roll has a distal end and a proximal end, and a seal is located at each of said ends, and wherein one of said nozzles is located at said distal end of said developer roll and the other of said nozzles is located at said proximal end of said developer roll.

6. The cartridge of claim 1, wherein said cartridge comprises a plurality of cartridges having a plurality of developer rolls and a plurality of J-seals providing J-seal interfaces therebetween, and further comprising a plurality of air ducts, each of said air ducts conducting air flow across each of said J-seal interfaces.

7. In an image forming device having a cartridge for containing toner material, a developer roll with proximal and distal ends, and a J-seal providing an interface between said developer roll and said cartridge at each of said proximal and distal ends, the improvement comprising:

an air duct disposed within said cartridge adjacent said developer roll for conducting air flow across said J-seal interfaces to cool said developer roll, said air duct comprising:

a body; and a pair of nozzles in fluid communication with said body, the pair of nozzles each being tapered in an axial direction and having an irregular quadrilateral cross-section.

8. The improvement of claim 7, and further comprising an air blower in fluid communication with said air duct for forcing air through said air duct to cool said developer roll.

9. The improvement of claim 7, wherein one of said pair of nozzles is located at said distal end of said developer roll proximate said J-seal and the other of said pair of nozzles is located at said proximal end of said developer roll proximate said J-seal.

10. The improvement of claim 7, wherein said body of said air duct has a regular rectangular cross-section.

11. The improvement of claim 7, wherein said cartridge comprises a plurality of cartridges having a plurality of developer rolls and a plurality of J-seals providing interfaces at the ends thereof, and further comprising a plurality of air ducts, one of said air ducts associated with one of said developer rolls, each of said air ducts conducting air flow across said J-seal interfaces.

12. The improvement of claim 11, and further comprising a manifold providing fluid communication with said plurality of air ducts.

13. An air duct in a cartridge for containing toner material, a developer roll, and a pair of seals providing an interface with said developer roll, said developer roll having a distal end and a proximal end, with one seal in each said pair of seals located at each of said distal and proximal ends, the air duct comprising:

a unitary structure insertably positionable within a housing of the cartridge and formed from an elongated hollow body and a pair of nozzles affixed to said elongated hollow body, the interior of the elongated hollow body in fluid communication with an air blower via an inlet and with the pair of nozzles, one of said nozzles being disposed at said distal end of said developer roll and the other of said nozzles being disposed at said proximal end of said developer roll.

14. The air duct of claim 13, wherein said elongated hollow body includes a neck portion for fluid communication with said air blower.

15. The air duct of claim 13, further comprising:

a plurality of unitary structures inserted within a corresponding plurality of cartridges; and a manifold in fluid communication with said inlets in said plurality of unitary structures and said air blower.

16. The air duct of claim 15, wherein said plurality of cartridges have a plurality of developer rolls and a plurality of J-seals providing J-seal interfaces therebetween, each of said air ducts conducting air flow across each of corresponding said J-seal interfaces.

* * * * *